US009611019B2

(12) United States Patent
Spencer

(10) Patent No.: US 9,611,019 B2
(45) Date of Patent: Apr. 4, 2017

(54) WATER WALKER

(71) Applicant: Robert F. Spencer, Concord, NH (US)

(72) Inventor: Robert F. Spencer, Concord, NH (US)

( * ) Notice: Subject to any disclaimer, the term of this patent is extended or adjusted under 35 U.S.C. 154(b) by 0 days.

(21) Appl. No.: 14/712,141

(22) Filed: May 14, 2015

(65) Prior Publication Data

US 2015/0329189 A1 Nov. 19, 2015

Related U.S. Application Data

(60) Provisional application No. 62/053,979, filed on Sep. 23, 2014, provisional application No. 61/994,327, filed on May 16, 2014.

(51) Int. Cl.

| | |
|---|---|
| ***B63B 1/32*** | (2006.01) |
| ***B63H 16/02*** | (2006.01) |
| ***B63H 16/04*** | (2006.01) |
| ***B63B 35/73*** | (2006.01) |
| ***B63H 1/32*** | (2006.01) |
| ***B63B 35/81*** | (2006.01) |

(52) U.S. Cl.

CPC ..... *B63H 1/32* (2013.01); *B63B 35/73* (2013.01); *B63B 35/81* (2013.01); *B63B 35/812* (2013.01); *B63H 16/02* (2013.01); *B63H 16/04* (2013.01)

(58) Field of Classification Search

CPC ..... B63H 16/00; B63H 16/02; B63H 16/04; B63H 35/73; B63H 35/81; B63H 35/812; B63H 1/32; B63H 35/79; B63H 35/83; B63H 35/85; B63B 35/73; B63B 35/81; B63B 35/812; B63B 1/32; B63B 35/79; B63B 35/83; B63B 35/85

USPC ..... 440/21; 441/76, 77

See application file for complete search history.

(56) References Cited

U.S. PATENT DOCUMENTS

| | | | | |
|---|---|---|---|---|
| 1,014,993 | A | 1/1912 | Anderson | |
| 1,344,225 | A | 6/1920 | Halbow | |
| 1,413,602 | A | 4/1922 | Michalski | |
| 2,153,939 | A | 4/1939 | Schaupp | |
| 3,084,356 | A | 4/1963 | Wheat | |
| 3,112,504 | A * | 12/1963 | Carlton | B63B 35/83 441/77 |
| 3,121,892 | A | 2/1964 | Plumlee | |
| 3,936,897 | A | 2/1976 | Schaumann | |
| 4,117,562 | A | 10/1978 | Schaumann | |
| 4,261,069 | A | 4/1981 | Schaumann | |
| 4,530,668 | A * | 7/1985 | Braun | B63B 35/811 114/354 |
| 4,541,809 | A | 9/1985 | Schaumann | |
| 4,698,039 | A | 10/1987 | Watson | |
| 5,593,334 | A | 1/1997 | Thayer | |
| 7,121,910 | B2 | 10/2006 | Rosen | |
| 7,354,326 | B2 | 4/2008 | Lukens | |
| 7,361,071 | B1 | 4/2008 | Lauren | |
| 8,075,358 | B2 | 12/2011 | Yesil et al. | |

(Continued)

*Primary Examiner* — Lars A Olson

(74) *Attorney, Agent, or Firm* — Roberts Mlotkowski Safran Cole & Calderon P.C.; George H. Spencer

(57) ABSTRACT

Disclosed is a human powered water walker having a plurality of two-position flippers for effecting propulsion and steering of the water walker when the same is is actuated by human power. Each of the flippers is beveled at its front end and has at its rear end a downwardly beveled tab. The water walker may have two interlaced boyant ski trimarans to which the flippers are connected.

23 Claims, 9 Drawing Sheets

(56) References Cited

U.S. PATENT DOCUMENTS

| | | | | |
|---|---|---|---|---|
| 2003/0203686 | A1* | 10/2003 | Rothschild | B63H 16/08<br>441/77 |
| 2013/0231014 | A1* | 9/2013 | Knutson | B63H 16/00<br>440/21 |

* cited by examiner

WATER WALKER

The present invention relates to a human powered water walker having two interlaced buoyant ski trimarans and multiple attached two-position flippers for propulsion and steering.

The long-standing goal of a commercially viable human powered water walker has been limited by issues of stability, effective propulsion/steering, and complexity of design/manufacture. The present invention addresses each of these issues in new and unique ways while providing an elegant means for gliding over the surface of water or other liquid medium in a manner that simulates cross-country skiing on snow.

Stability in pitch and roll of each foot individually is achieved by the elongated shape of the buoyant skis for pitch and the three-ski trimaran configuration for roll. The interlacing of the two trimarans by means of four cross bars with each set of two cross bars attached to only one trimaran provides a limited degree of independent up/down motion, lateral movement, and yaw of each foot relative to the other. There is the ability to move each foot independently forward/back to achieve a functional stride the length of which is determined by the length of the skis and the relative positions of the four cross bars. The amount of lateral movement of each foot is determined by the length of the crossbars in relation to the width of the skis. The longer the crossbars or narrower the skis, the greater the allowed lateral movement. Up/down movement of each trimaran relative to the other is limited by the spacing between the lower horizontal surface of the crossbars of one trimaran and the top of the skis of the other trimaran to which that crossbar is not attached. Minimal independent movement of each foot in yaw is determined by a combination of the length of the crossbars relative to the width of the skis as well as the length of the skis. Both cross bars of one trimaran are a greater distance away from the location of the foot placement on that trimaran than the crossbars of the other trimaran are from the location of the foot placement on it. Which trimaran (left or right) having closer or more distant cross bars is arbitrary.

Prior attempts to provide a human powered water walker have generally relied on some sort of direct connection between the two units of each foot in order to provide stability and limitation of movement in one direction or another. This solution is inherently inferior as any movement of one foot immediately places some force on the unit attached to the other foot. The present invention has no connection between the two units and only provides an interactive force when the desired limits of movement have been reached. Also, the present invention has the advantage of elegance in design and simplicity in manufacture in that it requires no additional mechanism, other than the interlaced trimaran configuration, to achieve the goals of stability and limited relative motion.

Other attempts to provide a human powered water walker have required placement of the foot into a well deep inside the buoyant ski in order to lower its center of gravity or, in other cases, at least requires a means of attaching the foot to the ski. Due to the inherent stability of the current design, assuming use of a surface with adequate friction between the sole and the top of the ski, the foot can rest on the surface of the ski and does not need to be attached at all. This absence of attachment or deep insertion of the foot into the device is more convenient and improves safety if the user must quickly abandon the craft for any reason.

The interlaced trimaran configuration also has the advantage of providing a relatively large surface area on the bottom of the skis for placement of flippers to aid in propulsion and steering. Because the flippers act on a liquid medium rather than on snow as in cross-country skiing, they perform best if spaced apart longitudinally (fore/aft) by a distance equal to or greater than the distance of one stride. This distance avoids the problem of "shadowing" where one flipper moving backward in the water reaches the point of water turbulence created by another flipper. The fact that the present invention has six skis with each bottom surface sufficiently long to accommodate multiple flippers provides an advantage in terms of propulsive force.

The present invention also describes a new and improved flipper for propulsion and steering. In one embodiment, each flipper is shaped like an elongated rectangular box with a bottom and two sides but with the top and both ends removed. Viewed from the side, the front end of the flipper is beveled (45 degrees in the preferred embodiment but other angles may be used) and attached at a pivot point such that the flipper has two extremes of position: "up" with the top of the flipper flush against the bottom surface of the ski or "down" with the front of the flipper flush against the bottom of the ski and the rest of the flipper at an angle (45 degrees in the preferred embodiment) to the bottom surface of the ski.

The flipper is in the "up" position during forward motion through the water. In this position, there is low cross sectional surface area exposed and therefore very little drag is produced and the sides of the flipper also function as would a keel or fins, thus providing straighter tracking through the water.

The flipper is in the "down" position during rearward motion through the water. In this position, there is a large cross sectional surface area when viewed from the rear allowing significant propulsive force to be exerted against the water, as would be achieved by a paddle.

On the rear edge of the bottom of each flipper is an adjustable tab that can be bent downward at angle varying between zero and 45 degrees. This tab helps return or keep the flipper in its "up" position during forward motion through the water, although the flipper would tend to do so even without this tab. More critically, the tab functions to move the flipper to its full "down" position during the initial rearward movement through the water. Note that the rearward movement of the flipper must exceed the forward movement of the craft as a whole through the water for the net forces to be sufficient to move the flipper down. The beveled sides at the front of the flipper limit downward travel and the sides of the flipper provide a "cupping" function that improves its efficiency as a paddle.

Steering of the craft as a whole can be achieved by providing a greater rearward thrust of one foot compared to the other. For example if the left foot is kept still and the right foot is slowly moved forward then quickly moved backward, the craft would tend to turn left. Vice versa, if the left foot is moved rearward with greater force and speed than the right foot, the craft will steer to the right.

For improved steering, the trimaran configuration also allows the option of placing propulsion flippers on only the center and lateral floating skis, leaving the propulsion flippers off of the medial skis, i.e., leaving flippers off of the ski on the left side connected to the right foot and the ski on the right side connected to the left foot. While employing this option reduces the overall propulsive force of each stride, it ensures that the propulsive force exerted by each foot is all unilateral, i.e., only to port or only to starboard of the centerline of the craft as a whole, thus maximizing the turning tendency of the craft in the direction away from the retreating foot. Thus the user may choose to facilitate steering at the expense of reduced forward propulsion. This goal may also be accomplished without removing the propulsive flippers. Rather than removing the flippers, the user may disable each flipper on those two skis by bending the adjustable tab on the rear edge of each flipper so that it is flush with bottom surface of the flipper. Without the tab protruding into the relative flow of the water during rearward movement, the flipper will tend to remain flush against the bottom of the ski in its up position and not participate in propulsion. A compromise between no propulsion and full propulsion can be obtained by placing the tab in an intermediate position.

The inherent stability of the craft as a whole allows use of a paddle, similar to a paddleboard's, to be used as an alternative or supplemental means of propulsion and steering if desired. Use of a paddle would also provide exercise of the upper body and/or relative rest of the lower body and legs.

Flippers can be recessed inside the floating ski for reduced drag in the water and for protection of the flippers while in shallow water or on land. Another method for protecting the flippers is for side panels to be attached to both sides of each ski extending below the flippers. Alternatively, the structure of the buoyant skis may be manufactured to extend a distance below the flippers on both sides of each ski so that the skis may rest on a structure other than the flippers.

An optional set of two poles may be used with one end of each pole attached to one end of a single trimaran and the other end of each pole held in the operator's left or right hand. In the preferred embodiment, poles are attached to a pivot point at the stern (aft end) of the medial ski of each trimaran. This configuration allows the pole attached to the right trimaran to be held in the operator's left hand and the pole attached to the left trimaran to be held in the right hand. Other configurations are possible if the user would prefer to move the right hand and right foot together in the same direction and the left hand and left foot together in the same direction. The use of such poles would allow the operator to use his or her arms as well as legs to manipulate the skis thereby providing upper body exercise as well and more closely simulating cross-country skiing on snow.

These poles may have blades at one end and may be detached then connected to each other to form either a longer pole or a single bladed (stand up paddle board type) paddle or a two bladed (kayak type) paddle.

The components of the water walker according to the present invention may be made of any of a variety of materials including plastic, PVC, fiberglass, carbon fiber, composite, wood, foam, metal or other materials as long as the skis provide sufficient buoyancy and strength to support the weight of the operator and the cross bars and flippers provide sufficient strength to serve their respective functions. The buoyancy of the skis may also be provided by use of hollow airtight compartments or cells created with use of any or all of these materials. The top surface of the skis where the feet are placed is made with a textured surface and/or coating of rubber or other similar material to facilitate grip of the feet on the surface even when wet. Ideally, detachable components such as the paddle/poles would be buoyant enough to float if dropped in the water.

The inherent stability of the craft as a whole allows the operator to climb onto or off of the craft with relative ease while it is floating in the water.

Although the inherent stability of the craft as a whole allows for operation without them, straps or other devices for attaching the feet to the top of the skis may be used if desired.

Moreover, a water walker according to the present invention which comprises a set of two interlaced buoyant ski trimarans may be used with a propulsion and/or steering system different from the invention comprising the two-position flippers.

Also, according to the present invention, the two-position flippers shown as a mean for propulsion and steering may be used to propel and/or steer a human powered water craft different from the invention comprising a set of two interlaced buoyant ski trimarans.

Additional features and options are as listed below:

Number of flippers described is four per ski but more or fewer can be used.

Number of skis is three per foot but more or fewer can be used.

Support clips may be attached to the top of the cross bars overlying the ski to which the paddle/poles are attached and allow them to be rested/clipped to their respective ski while being held above and clear of the cross bars allowing the user to operate the device without needing to hold the paddle/poles.

Flippers can be altered at the front to allow for attachment with the sides of the flipper including the pivot point being on each side of the ski.

The skis and flippers may be rectangular in cross section or may be of a different shape. For example, the bottom of the ski and the attached flippers may be U shaped, V shaped, or other shapes.

The adjustable tabs on each flipper may be made fixed or alternatively formed as integral to the flipper by creating an angle of downward bend of the entire aft end of each flipper.

The flippers can be made without a tab and rely solely on gravity to initiate the downward motion or with the assistance of a spring or other device to keep them in either the up or the down position when no other force is applied.

Spacers or blockers may be attached on the bottom of the crossbars extending downward between two skis or in a slot on the top of an individual ski and used to limit lateral travel of one ski (or set of skis) in relation to another.

These spacers or blocker may be fixed or attached in a manner that allows them to rotate as bearings to reduce friction of the movement of one ski (or set of skis) in relation to another.

The distance between the bottom of the cross bars of one unit (set of skis) and the top of the other unit may be minimal and allow for only slight or no relative up/down movement of one unit in relation to the other.

A roller or bearing may be used between the bottom of the cross bar of one unit (set of skis) and the top of the ski(s) of the other unit to reduce friction of the movement of one unit relative to the other.

The crossbars may extend over the lateral ski of the other trimaran unit to facilitate stability both during use and when carrying or transporting the device outside of the water.

For background information, reference is made to the following sixteen U.S. Pat. Nos. 1,014,993, 1,344,225, 1,413,602, 2,153,939, 3,084,356, 3,121,892, 3,936,897, 4,117,562, 4,261,069, 4,541,809, 4,698,039, 5,593,334, 7,121,910, 7,354,326, 7,361,071, 8,075,358.

Reference is also made to prior U.S. Provisional Patent Application No. 61/994,327 for WATER WALKER that was filed May 16, 2014 and U.S. Provisional Patent Application No. 62/053,979 for WATER WALKER that was filed Sep. 23, 2014.

DETAILED DESCRIPTION OF THE PREFERRED EMBODIMENTS

The following is a detailed description of a water walker according to the present invention.

Figure 1:
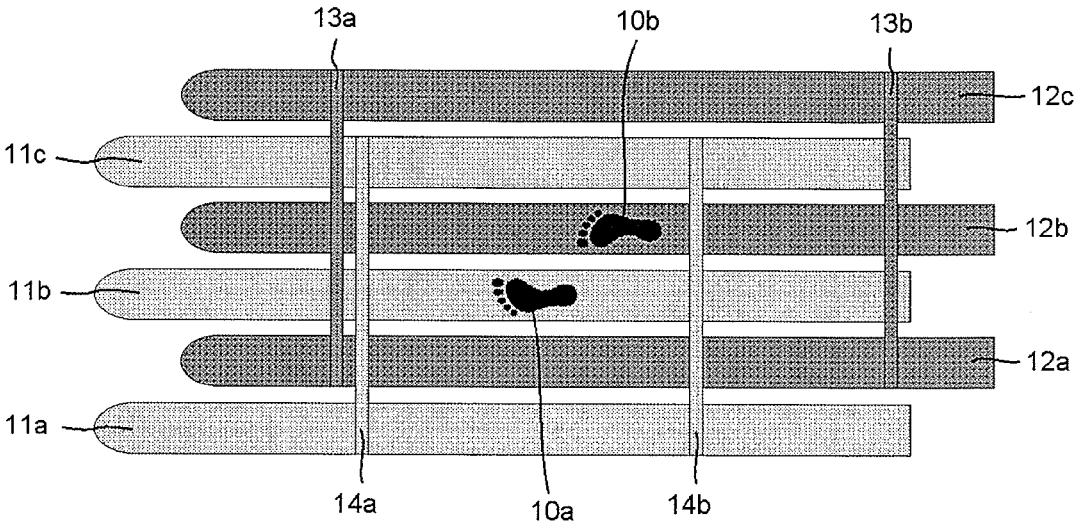
FIG. 1 is a top plan of a water walker according to the present invention with the right foot trimaran, shown in darker color, being moved rearward or aft.

FIG. 1 is a top view of the craft with the right foot timaran (darker color) being move rearward (aft). The right trimaran is composed of three skis: a center ski 12*b*, right/lateral ski 12*c*, and left/medial ski 12*a*. The left trimaran is comprised of three skies: a center ski 11*b*, left/lateral ski 11*a* and right/medial ski 11*c*. For a given trimaran, the lateral ski is father away from the longitudinal centerline of the craft as a whole on the same side as the center ski whereas the medial ski is on the opposite side of the longitudinal centerline. The three skis of the right trimaran are connected by two cross bars, one fore 13*a* and one aft 14*b*. The locations of the left foot 10*a* and the right foot 10*b* are marked with footprints in the upper surface of the center skis. The cross bars 18 and 13*b* of one trimaran (right as shown) are each a greater distance away from the location of the foot placement than the cross bars 14*a* and 14*b* of the other trimaran (left as shown) are from the location of the foot placement. The skis of each trimaran are interlaced with the skis of the other trimaran.

Figure 2:
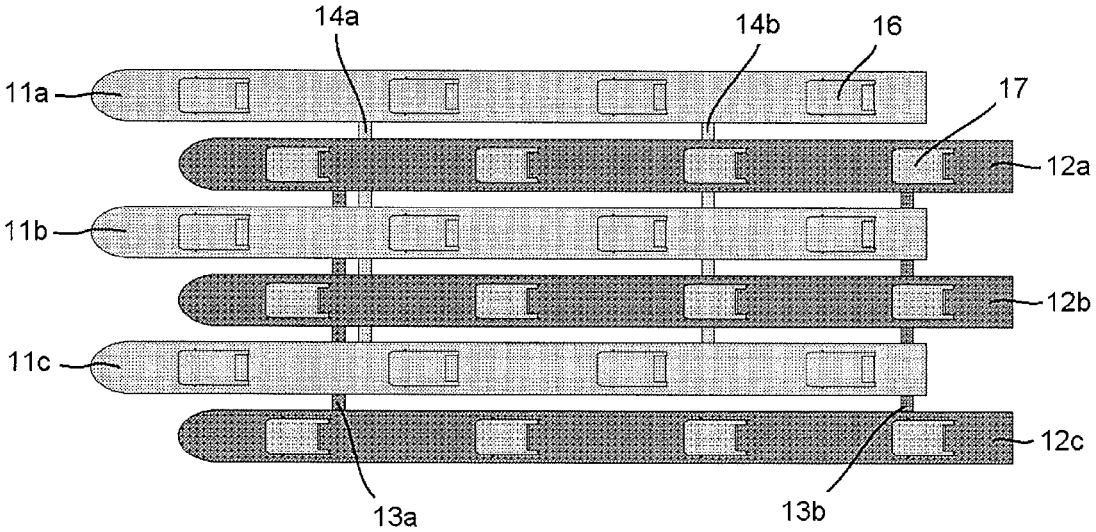
FIG. 2 is a bottom view of the water walker with the right foot trimaran ski being moved rearward or aft.

FIG. 2 is a bottom (underwater) view of the water walker with right foot trimaran skis 12*a*, 12*b*, 12*c* being moved rearward (aft). Components of the water walker are labeled as in FIG. 1. Also shown is an example of the placement of twenty-four propulsion flippers with the right foot trimaran's flippers 17 in the down position and the left foot trimaran's flippers 16 in the up position. While four flippers per ski are shown, more or fewer flippers may be provided.

Figure 3:
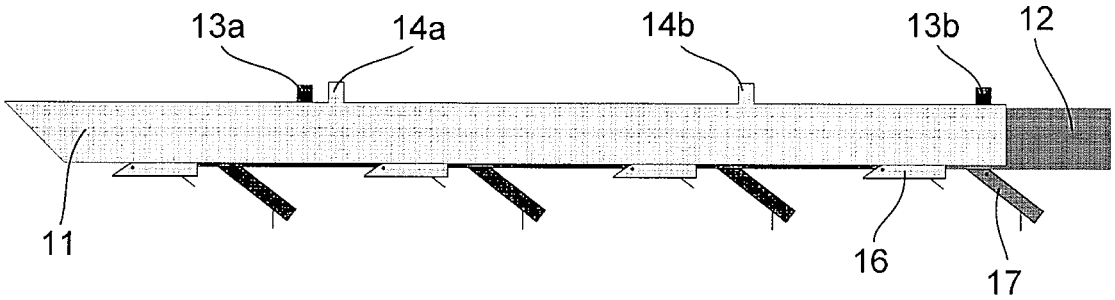
FIG. 3 is a side view of the left side of the water walker.

FIG. 3 is a side view of the left or port side of the craft. The right foot trimaran 12 being moved rearward (aft) has its flippers 17 in the down position. The left foot trimaran 11 is shown with its flippers 16 in the up position. The crossbars are labeled as in FIGS. 1 and 2.

Figure 4:
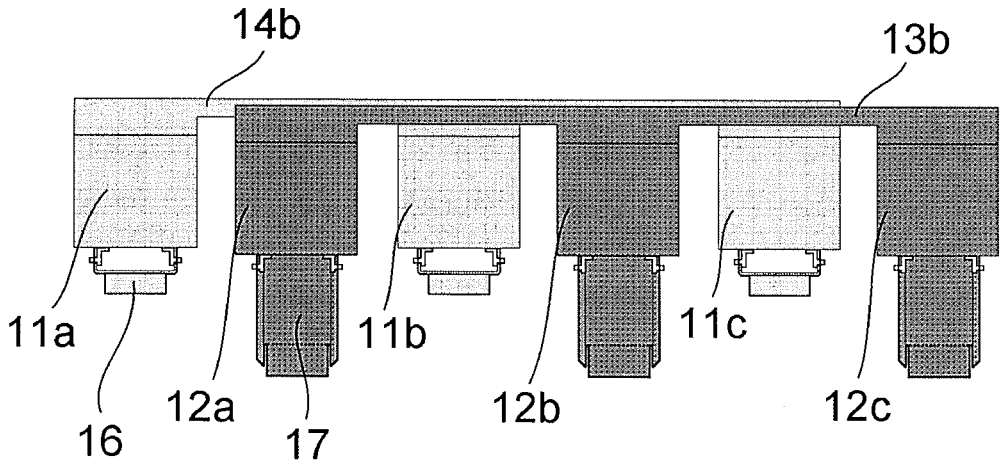
FIG. 4 is a rear view of the water walker.

FIG. 4 is a rear view of the water walker showing the right foot trimaran being moved rearward (aft) and with its flippers 17 in the down position and the flippers 16 of the left foot trimaran in the up position. Other components of the water walker are labeled as in FIG. 1.

Figure 5:
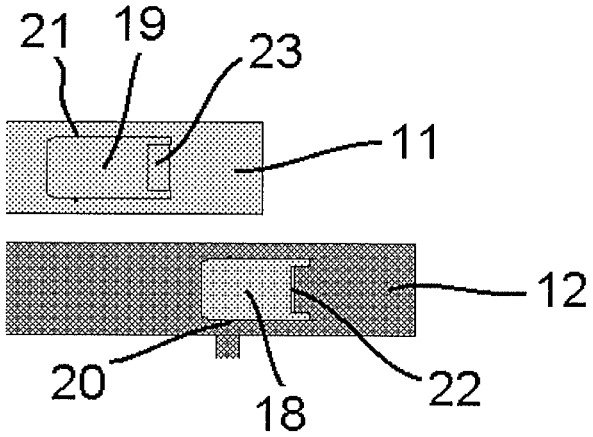
FIG. 5 is a detailed close up view of the water walker of FIG. 2, showing a bottom view of the aft section of two skis.

FIG. 5 is a detailed close up view of FIG. 2 showing a bottom view of the aft section of two skis with attached flippers, one in the up position and one in the down position. The up positioned flipper 19 with adjustable tab 23 is attached to ski 11 at pivot point 21. The down positioned flipper 18 with and adjustable tab 22 is attached to ski 12 at pivot point 20.

Figure 6:
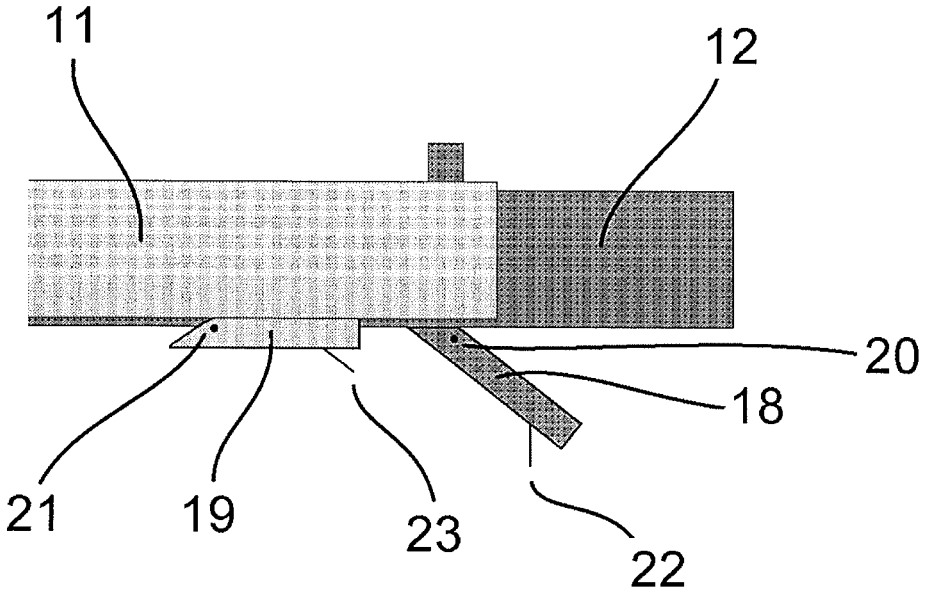
FIG. 6 is a detailed close up view of the water walker of FIG. 3, showing the aft section of two skis with attached flippers.

FIG. 6 is a detailed close up view of FIG. 3 showing a side view of the aft section of two skis with attached flippers, one in the up position and one in the down position. The up positioned flipper 19 with adjustable tab 23 is attached to ski 11 at pivot point 21. The down positioned flipper 18 with adjustable tab 22 is attached to ski 12 at pivot point 20.

Figure 7:
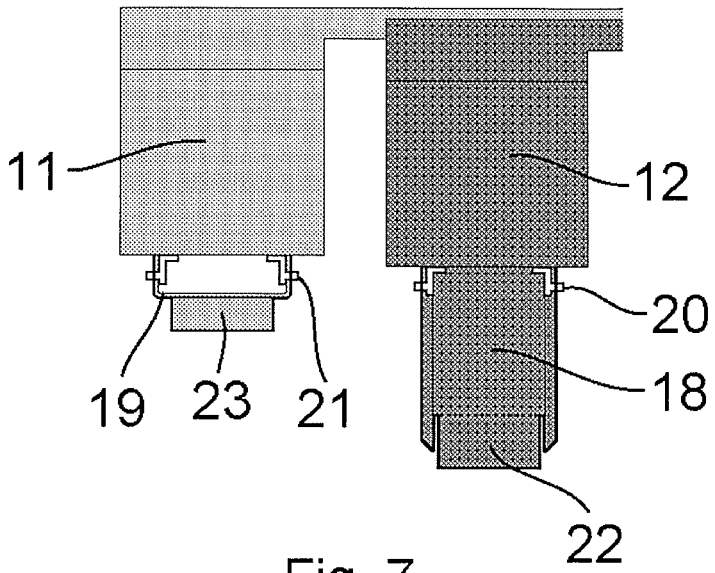
FIG. 7 is a detailed close up of the water walker of FIG. 4, showing a rear view of the aft section of two skis with attached flippers.

FIG. 7 is a detailed close up view of FIG. 4 showing a rear view of the aft section of two skis with attached flippers, one in the up position and one in the down position. The up positioned flipper 19 with adjustable tab 23 is attached to ski 11 at pivot point 21. The down positioned flipper 18 with adjustable tab 22 is attached to ski 12 at pivot point 20.

Figure 8:
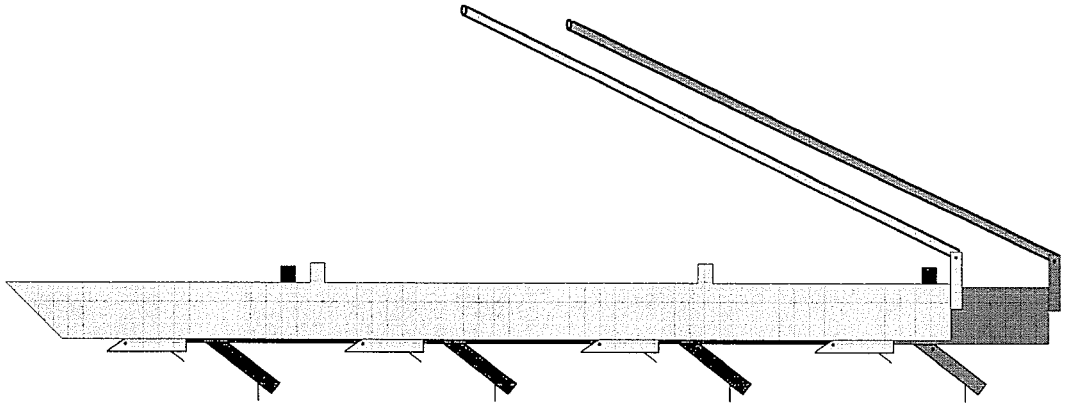
FIG. 8 is a side view similar to FIG. 3, additionally showing two optional poles.

FIG. 8 is a side view similar to FIG. 3 of a particular embodiment of the water walker showing additionally two optional poles linked to pivot points attached at the stern of the left and right trimaran in order to allow the operator to more closely simulate the act of cross country skiing on snow.

Figure 9:
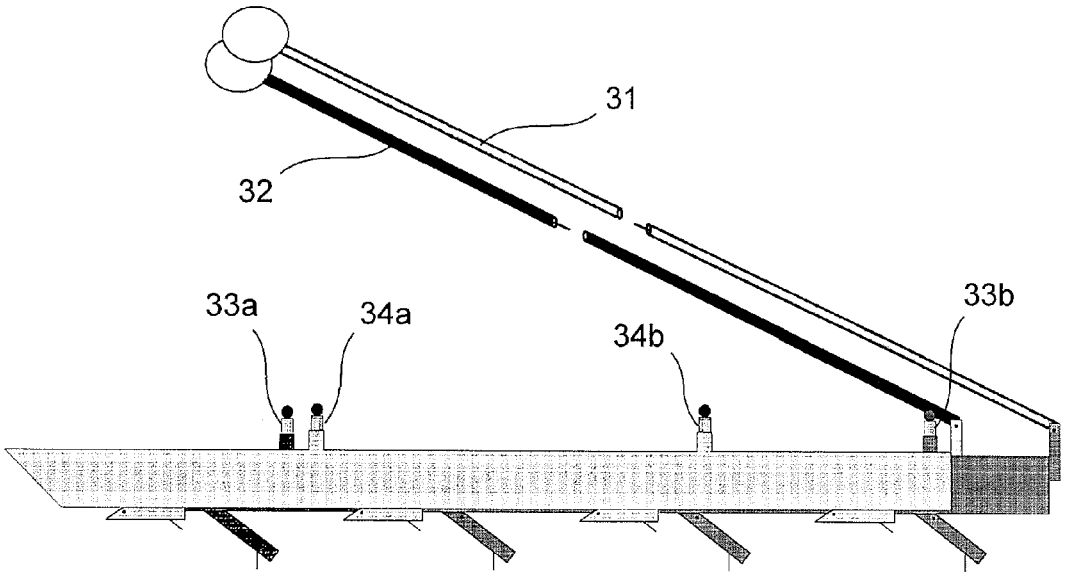
FIG. 9 is a side view similar to FIG. 8, showing two poles with removable paddles and the support clips attached to the top of the cross bars.

FIG. 9 is a side view similar to FIG. 8, of a particular embodiment showing the two poles (31 and 32) with paddle blades at one end and that they may be detached from the device, used either individually as a single bladed paddle, or connected to each other and be used as a two bladed (kayak type) paddle. In this embodiment, a paddle/pole (31) is attached to the left ski of the right foot trimaran and a paddle/pole (32) is attached to the right ski of the left foot trimaran. Support clips (33*a* and 33*b*) are attached to the top of the crossbars of the right foot trimaran overlying the left ski and support clips (34*a* and 34*b*) are attached to the top of the crossbars of the left foot trimaran overlying the right ski. This configuration allows the user's right arm and left foot (as well as left arm and right foot) to travel forward and backward together similar to the movements of cross country skiing on snow.

Figure 10:
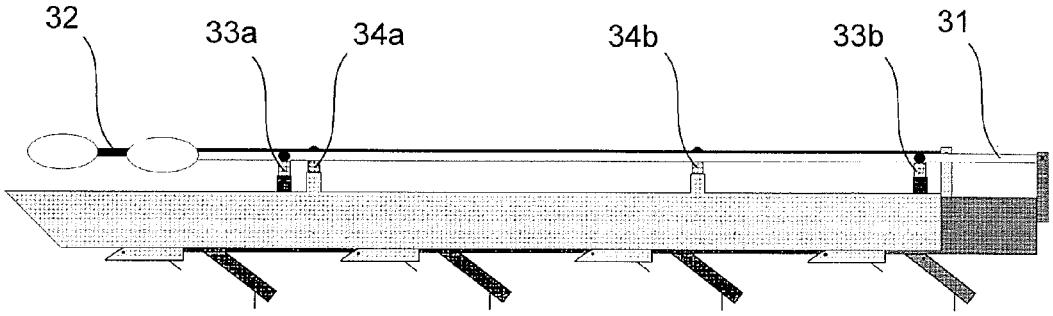
FIG. 10 is a side view similar to FIG. 9, showing the two paddle/poles resting in their respective support clips attached to the top of the cross bars.

FIG. 10 is a side view similar to FIG. 9, showing one of the paddle/poles (31) resting in support clips (33*a* and 33*b*) and the other paddle/pole (32) resting in support clips (34*a* and 34*b*) attached to the top of their respective crossbars. In this configuration, the user may operate the water walker without needing to hold the paddle/poles.

Figure 11:
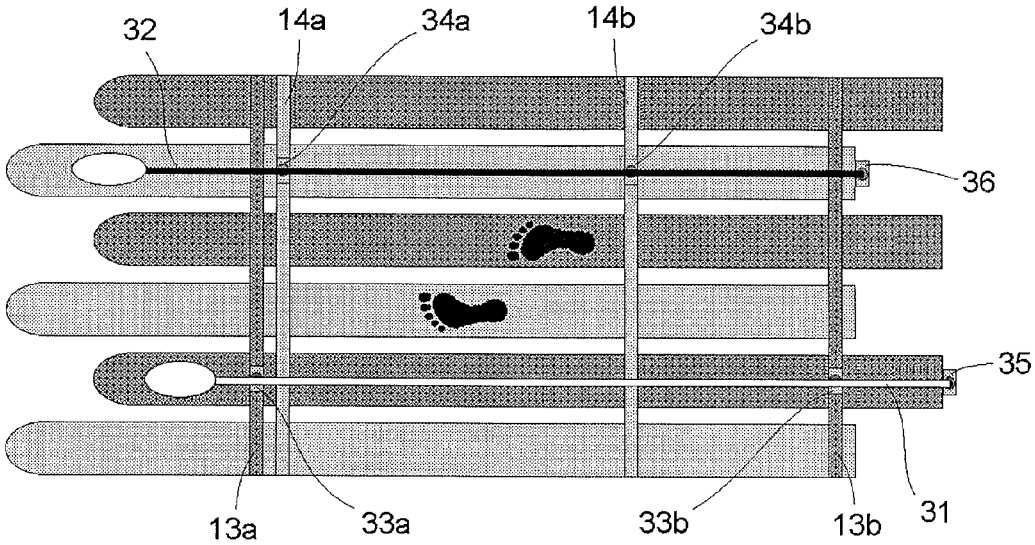
FIG. 11 is a top view similar to FIG. 1, showing the two paddle/poles resting in their respective support clips attached to the top of the cross bars.

FIG. 11 is a top view similar to FIG. 1, of the embodiment as shown in FIG. 9-10 with the left hand paddle/pole (31) resting in support clips (33*a* and 33*b*) attached to crossbars (13*a* and 13*b*) of the right foot trimaran and the right hand paddle/pole (32) resting in support clips (34*a* and 34*b*) attached to the crossbars (14*a* and 14*b*) of the left foot trimaran. Note that in this example, each crossbar extends over the entire width of the device including all three skis of the trimaran to which it is not attached.

Figure 12:
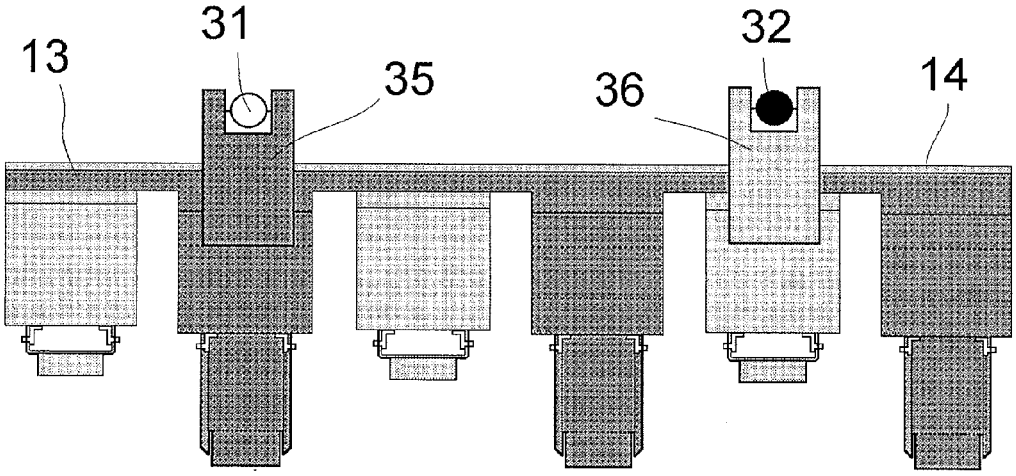
FIG. 12 is a rear view, similar to FIG. 4, showing the two paddle/poles and their attachments to their respective skis.

FIG. 12 is a rear view, similar to FIG. 4, of the embodiment as shown in FIG. 9-11 with the left hand paddle/pole (31) attached at pivot point (35) to the right foot trimaran and the right hand paddle/pole (32) attached at pivot point (36) to the left foot trimaran.

Figure 13:
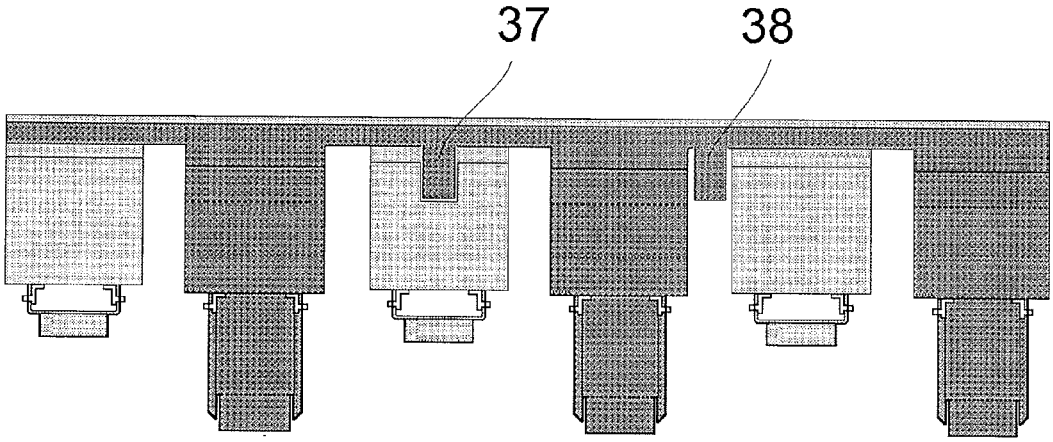
FIG. 13 is a rear view, similar to FIG. 4, showing the spacers or blockers attached on the bottom of the crossbar, one extending downward between two skis and the other in a slot on the top of an individual ski.

FIG. 13 is a rear view, similar to FIG. 4, showing two examples of a spacer or blocker attached on the bottom of a crossbar, one (38) extending downward between two skis and the other (37) in a slot on the top of an individual ski. Either or both of these types of spacers or blockers may be used to limit the lateral movement of one trimaran in relation to the other if desired.

Figure 14:
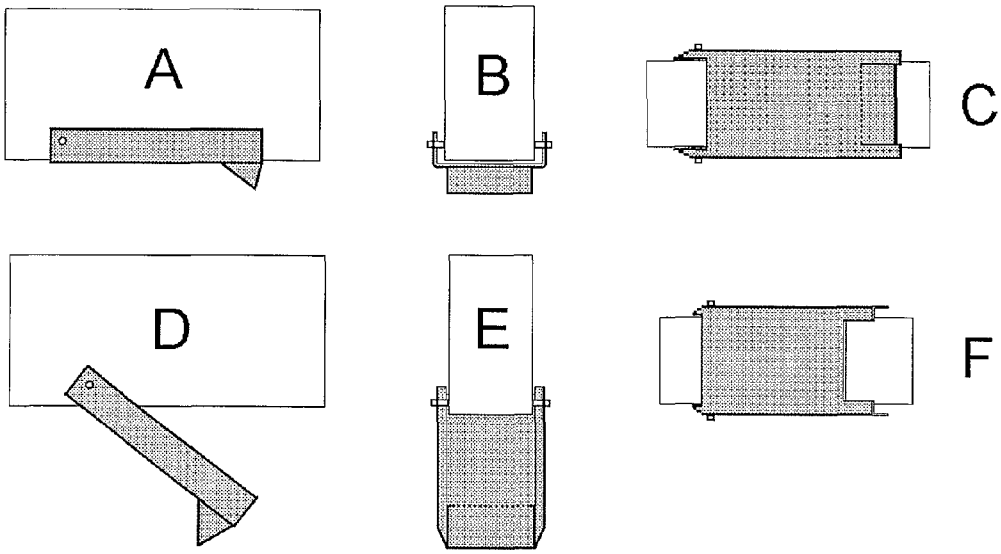
FIG. 14 shows the flipper attached to each side of a ski from the side, rear, and bottom in both the up and down positions.

FIG. 14 shows multiple detailed views of an embodiment with the flipper attached to each side of a ski with the flipper in the up position viewed from the side (14*a*), rear (14*b*), and bottom (14*c*) and with the flipper in the down position viewed from the side (14*d*), rear (14*e*), and bottom (14*f*).

Figure 15:
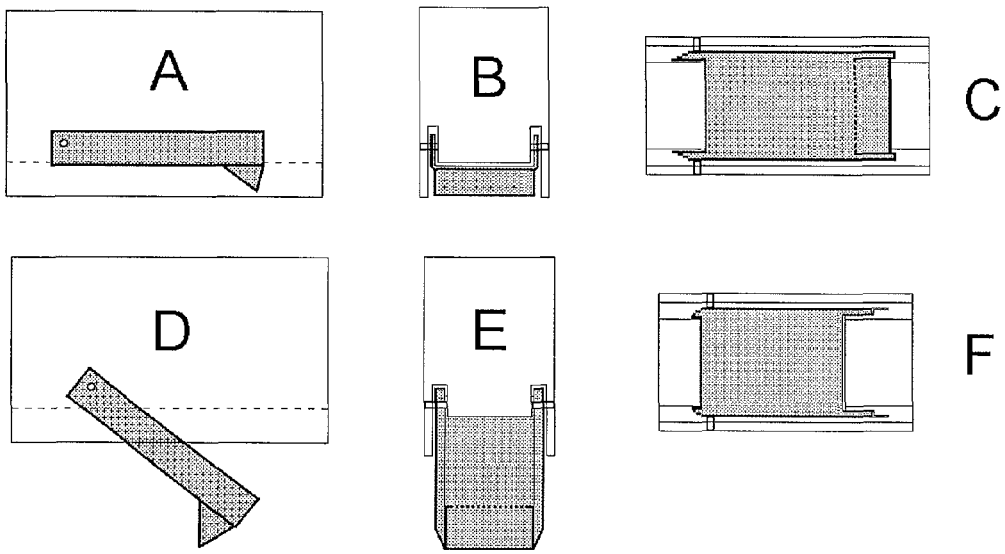
FIG. 15 shows the flipper recessed inside the bottom of a ski from the side, rear, and bottom in both the up and down positions.

FIG. 15 shows multiple detailed views of an embodiment with the flipper recessed inside the bottom of a with the flipper in the up position viewed from the side (15*a*), rear (15*b*), and bottom (15*c*) and with the flipper in the down position viewed from the side (15*d*), rear (15*e*), and bottom (15*f*).

Figure 16:
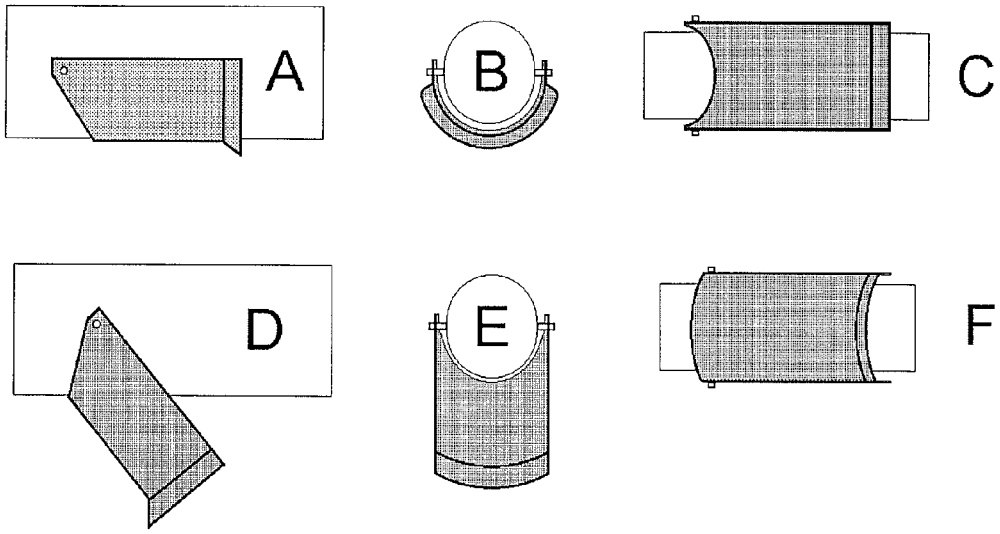
FIG. 16 shows a U shaped flipper attached to each side of a circular cross-section shaped ski from the side, rear, and bottom in both the up and down positions.

FIG. 16 shows multiple detailed views of an embodiment with a U shaped flipper attached to each side of a circular cross-section shaped ski with the flipper in the up position viewed from the side (16*a*), rear (16*b*), and bottom (16*c*) and with the flipper in the down position viewed from the side (16*d*), rear (16*e*), and bottom (16*f*).

Figure 17:
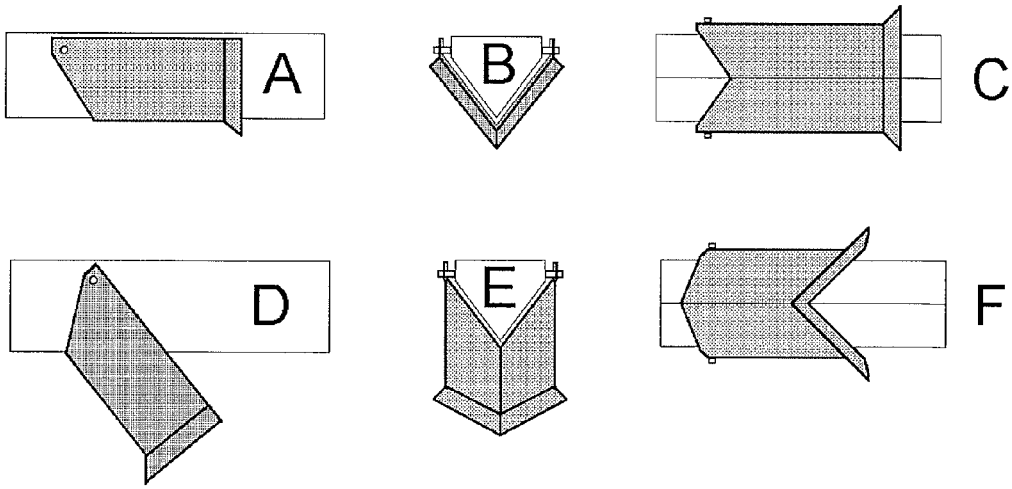
FIG. 17 shows a V shaped flipper attached to each side of a V bottom cross-section shaped ski from the side, rear, and bottom in both the up and down positions.

FIG. 17 shows multiple detailed views of an embodiment with a V shaped flipper attached to each side of a V bottom cross-section shaped ski with the flipper in the up position viewed from the side (17*a*), rear (17*b*), and bottom (17*c*) and with the flipper in the down position viewed from the side (17*d*), rear (17*e*), and bottom (17*f*).

It will be understood that the above description of the present invention is susceptible to various modifications, changes and adaptations and the same are intended to be comprehended within the meaning and range of the equivalents of the appended claims.

The invention claimed is:

1. A human powered water walker comprising two interlaced buoyant trimarans each of which has skis, the skis of each trimaran being interlaced with the skis of the other trimaran, and a plurality of two-position flippers connected to said trimarans for effecting propulsion and steering of the water walker when the same is actuated by human power.

2. A human powered water walker as defined in claim 1 wherein said flippers are positioned on the underside of the respective ski to which each respective flipper is attached.

3. A human powered water walker as defined in claim 2 wherein each flipper is in the form of an elongated box having a bottom and two sides.

4. A human powered water walker as defined in claim 3 wherein the front end each of said flippers is beveled.

5. A human powered water walker as defined in claim 4 wherein the angle of said bevel is 45 degrees.

6. A human powered water walker as defined in claim 2 wherein each of said flippers is movable between an up position wherein the top of the flipper is flush against the bottom surface of the ski and a down position wherein the front end of the flipper is flush against the bottom surface of the ski and the flipper as a whole is at an angle with respect to the bottom of the ski.

7. A human powered water walker as defined in claim 6 where said angle is 45 degrees.

8. A human powered water walker as defined in claim 6 wherein each of said respective flippers has a tab on its rear edge.

9. A human powered walker water as defined in claim 8 wherein said tab of each respective flipper is beveled downward.

10. A human powered walker water as defined in claim 9 wherein said tab of each of said respective flippers is adjustable by up to 45 degrees.

11. A human powered water walker as defined in claim 9 wherein said tab of each of said respective flippers is fixed at a downward angle of 45 degrees.

12. A human powered walker water as defined in claim 6 wherein each of said respective flippers is recessed inside the bottom of the respective ski to which the flipper is attached with only the tab of the flipper protruding below the respective ski when the flipper is in the up position.

13. A human powered water walker as defined in claim 1 wherein the cross sectional configuration of each of said respective flippers is the same as the cross sectional configuration of the underside of the respective ski to which the flipper is attached, each of said respective flippers being attached to the sides of the respective ski to which it is attached.

14. A human powered water walker as defined in claim 13 wherein said cross sectional configuration is in the form of any combination of rectangular, curved and V shapes along the length of the underside of the respective ski.

15. A human powered water walker as defined in claim 1 further comprising two poles each being attached to a respective one of said trimarans.

16. A human powered water walker as defined in claim 15 where each of said poles is attached to the aft end of the trimaran to which it is attached.

17. A human powered water walker as defined in claim 15 wherein each of said poles is detachably mounted on the respective trimaran.

18. A human powered water walker as defined in claim 15 wherein each of said poles has an end in the shape of a paddle whereby each pole may be used individually as a paddle.

19. A human powered water walker as defined in claim 15 wherein said two poles may be connected together to form a single paddle each of whose two ends is in the shape of a paddle thereby allowing the connected together poles to be used as a single paddle having two ends each of which is in the shape of a paddle.

20. A human powered water walker comprising at least two skis and at least two two-position flippers each of which is affixed to a respective ski for effecting propulsion of the water walker when the same is actuated by human power, each of said flippers being beveled at its front end by an angle of up to 45 degrees.

21. A human powered water walker as defined in claim 20 wherein each of said flippers has at its rear end a downwardly beveled tab that is adjustable by an angle of up to 45 degrees.

22. A human powered water walker as defined in claim 20 wherein the cross sectional configuration of each of said flippers is the same as the cross sectional configuration of the underside of the respective ski to which the flipper is attached, each of said respective flippers being attached to the sides of the respective ski to which it is attached.

23. A human powered water walker comprising two interlaced buoyant trimaran each of which has skis, the skis of each trimarans being interlaced with the skis of the other trimaran.

* * * * *